United States Patent [19]

Ariga

[11] 4,368,229

[45] Jan. 11, 1983

[54] INDICATOR PANEL FIXING ARRANGEMENT

[75] Inventor: Shoji Ariga, Toda, Japan

[73] Assignee: Clarion Co., Ltd., Tokyo, Japan

[21] Appl. No.: 239,951

[22] Filed: Mar. 3, 1981

[30] Foreign Application Priority Data

Mar. 10, 1980 [JP] Japan ..... 55-31561[U]

[51] Int. Cl.[3] ..... G12B 9/10; E04C 2/38

[52] U.S. Cl. ..... 428/120; 428/137; 52/822; 52/823; 248/27.1; 206/459; 40/312

[58] Field of Search ..... 428/13, 14, 131, 47, 428/101, 119, 137, 138, 120; 40/10 R, 156, 158 B, 158 R, 157, 489, 312; 206/455, 459, 449; 248/27.1; 52/822, 823, 812, 309.13

[56] References Cited

U.S. PATENT DOCUMENTS 3,264,770 8/1966 Baptie ..... 40/10 R

*Primary Examiner*—George F. Lesmes
*Assistant Examiner*—Alexander S. Thomas
*Attorney, Agent, or Firm*—Flynn, Thiel, Boutell & Tanis

[57] ABSTRACT

An indicator panel fixing arrangement for fixing a flat indicator panel, which is generally formed in a channel-shape having a bottom portion and sidewall portions standing upright from the bottom portion. One of the sidewall portions has, on the inside thereof, at a position near the bottom portion, a guide member for guiding the indicator panel onto the bottom portion. The arrangement may further includes another guide member provided on the inside of the bottom portion at a position remote from the former guide member.

4 Claims, 2 Drawing Figures

INDICATOR PANEL FIXING ARRANGEMENT

BACKGROUND OF THE INVENTION

This invention relates to an indicator panel fixing arrangement suitable for fixing a flat indicator panel such as a power indicator for an acoustic apparatus, etc.

To mount an indicator panel having a flat surface, such as a power indicator of an acoustic apparatus, e.g., a radio, a stereo, a radio-cassette player, etc., onto a required position, the indicator panel is fixed by hot welding or high-frequency welding because such an indicator panel is generally made of plastic. It is common to use a jig in the welding operation for fixing the indicator panel. However, if the place to which the indicator panel is fixed is very narrow, it is difficult or impossible to use the jig, so that the welding operation becomes difficult, possibly causing defective welding and spoiling the appearance of the product due to poor finish.

SUMMARY OF THE INVENTION

It is therefore an object of the present invention to provide an indicator panel fixing arrangement which is capable of facilitating an operation of fixing the indicator panel to the related apparatus.

In accordance with the present invention, there is provided an indicator panel fixing arrangement comprising;

a flat indicator panel;

a bottom portion having a window corresponding to said indicator panel;

at least two sidewall portions provided at opposite ends of said bottom portion;

a guide member provided on the inside of one of the sidewall portions, at a position near said bottom portion, for guiding said indicator panel into a position on said bottom portion where said indicator panel is to be fixed.

DESCRIPTION OF THE EMBODIMENT

Figure 1:
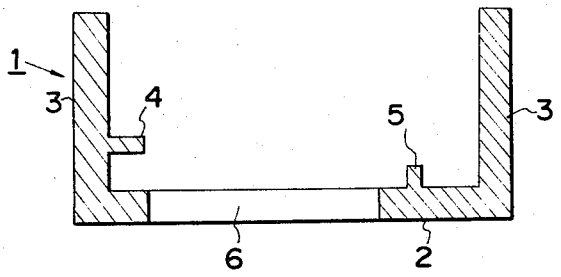
FIG. 1 is a sectional view of one embodiment of an indicator panel fixing device according to the present invention.

Referring now to the drawing, there is illustrated one embodiment of the present invention. FIG. 1 illustrates an indicator panel fixing arrangement. A body 1 on which an indicator panel 7 is to be mounted is generally formed in a channel-shape. The body 1 is comprised of a bottom portion 2 and at least two sidewall portions 3 provided at opposite ends of the bottom portion 2. Although the body 1 is so disposed, in the drawing, that the bottom portion 2 is located downwardly for the convenience of the operation for fixing the indicator panel 7, the body 1 is mounted, for example, on an acoustic apparatus with the portion 2 facing, for example, forwardly. One of the sidewall portions 3 has, on the inside thereof, at a position near the bottom portion 2, a first, inwardly projecting guide member 4. The bottom portion 2 has a second vertically upwardly projecting guide member 5 on the inside thereof, at a position remote from the first guide member 4. The body 1 further has a window 6 in the bottom portion 2 for showing the indicator panel 7 therethrough when the panel is fixed in position.

Figure 2:
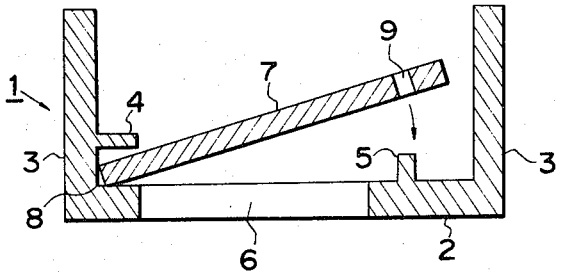
FIG. 2 is a similar sectional view of the embodiment of FIG. 1 showing the operation of fixing an indicator panel into position.

FIG. 2 illustrates a method for fixing the indicator panel 7 to the body 1. The indicator panel 7 is put below the guide member 4 and placed onto the bottom portion 2 of the body 1 while being guided by the guide member 4 as indicated by the arrow so that the indicator panel 7 may be positioned against the corner 8. The indicator panel 7 has an aperture 9 corresponding to the second guide member 5. The indicator panel 7 can be positioned accurately and positively in a required position by fitting the guide member 5 into the aperture 9. A welding operation is carried out after the indicator panel 7 has been positioned as described above, to properly fix the indicator panel 7 to the body 1.

When it is difficult to provide the guide member 5, the guide member 5 may be omitted. In this case, the indicator panel can be guided into the desired position by the guide member 4. Even when the sidewall portions 3 are high, the positioning of the indicator panel 7 can be effected smoothly by guiding the indicator panel 7 into position at an angle as shown in FIG. 2.

As described above, in accordance with the present invention, positioning of the indicator panel can be effected easily and accurately by using the guide member 4 alone or in combination with the guide member 5. Thus, the fixing operation can be facilitated very much, assuring good finish on the products.

I claim:

1. An indicator panel fixing arrangement comprising:

an elongated indicator panel having a flat lower surface, said indicator panel having an aperture therethrough at a position near to one end thereof;

a body member supporting said indicator panel, said body member including a base wall portion having a flat upper surface against which rests the flat lower surface of said indicator panel, said base wall portion of said body member having an elongated through opening located between its ends, said through opening defining a window through which said indicator panel is visible, said body member having two sidewalls extending upwardly from said flat upper surface of said base wall portion at the opposite ends thereof, one of said sidewalls having a first guide member extending laterally inwardly from its inner surface, between its upper and lower ends, at a location close to and spaced upwardly from said flat upper surface of said base wall portion and defining therewith a groove, the other end of said indicator panel being inserted in said groove between said first guide member and said flat upper surface of said base wall portion, a second guide member extending upwardly from said flat upper surface of said base wall portion at a location on the opposite end of said through opening from said first guide member, said second guide member being received in said aperture so that said indicator panel is accurately positioned on said body member.

2. An indicator panel fixing arrangement as claimed in claim 1 in which said first guide member extends parallel with said flat upper surface of said base wall portion and the inner edge of said first guide member is located directly above the adjacent end of said through opening, the thickness of said indicator panel being less than the vertical spacing between said flat upper surface of said base wall portion and the opposing lower surface of said first guide member so that there is a space between said first guide member and said indicator panel.

3. An indicator panel fixing arrangement as claimed in claim 1 or claim 2, wherein said indicator panel is affixed to said body member by welding.

4. An indicator panel fixing arrangement as claimed in claim 1 or claim 2, wherein said sidewalls are perpendicular to said base wall portion and said first guide member is perpendicular to said one sidewall.

* * * * *